US008726679B2

(12) United States Patent
Lifson et al.

(10) Patent No.: US 8,726,679 B2
(45) Date of Patent: May 20, 2014

(54) DEDICATED PULSING VALVE FOR COMPRESSOR CYLINDER

(75) Inventors: Alexander Lifson, Manlius, NY (US); Sriram Srinivasan, Hebron, CT (US); Paul J. Flanigan, Cicero, NY (US)

(73) Assignee: Carrier Corporation, Farmington, CT (US)

( * ) Notice: Subject to any disclaimer, the term of this patent is extended or adjusted under 35 U.S.C. 154(b) by 651 days.

(21) Appl. No.: 13/058,725

(22) PCT Filed: Aug. 11, 2009

(86) PCT No.: PCT/US2009/053417

§ 371 (c)(1),
(2), (4) Date: Feb. 11, 2011

(87) PCT Pub. No.: WO2010/019582

PCT Pub. Date: Feb. 18, 2010

(65) Prior Publication Data

US 2011/0132015 A1 Jun. 9, 2011

Related U.S. Application Data

(60) Provisional application No. 61/088,139, filed on Aug. 12, 2008.

(51) Int. Cl.
*F25B 49/02* (2006.01)
*F04B 35/00* (2006.01)

(52) U.S. Cl.
USPC ..... 62/228.1; 62/510; 417/415

(58) Field of Classification Search
USPC ..... 62/196.1, 217, 228.1, 228.5, 510; 417/415, 419
See application file for complete search history.

(56) References Cited

U.S. PATENT DOCUMENTS

| | | | | |
|---|---|---|---|---|
| 4,486,157 | A | 12/1984 | Hayashi | |
| 4,947,655 | A * | 8/1990 | Shaw | 62/200 |
| 5,237,907 | A | 8/1993 | Poschl | |
| 6,206,652 | B1 * | 3/2001 | Caillat | 417/298 |

FOREIGN PATENT DOCUMENTS

| | | | |
|---|---|---|---|
| CN | 1245869 | A | 3/2000 |
| JP | 62-007984 | A | 1/1987 |

OTHER PUBLICATIONS

Notification of Transmittal of the International Search Report and the Written Opinion of the International Searching Authority; PCT/US2009/053417; mailed Jan. 29, 2010; Korean Intellectual Property Office.

* cited by examiner

*Primary Examiner* — Marc Norman
(74) *Attorney, Agent, or Firm* — Cantor Colburn LLP

(57) ABSTRACT

A reciprocating piston compressor for use in a refrigerant compression circuit comprises first and second intake manifolds, first and second reciprocating piston compression units, an outlet manifold and a first pulsing valve. The intake manifolds segregate inlet flow into the compressor. The first and second reciprocating piston compression units receive flow from the first and second intake manifolds, respectively. The outlet manifold collects and distributes compressed refrigerant from the compression units. The first pulsing valve is mounted externally of the first intake manifold to regulate refrigerant flow into the first intake manifold. In another embodiment, a second valve is mounted externally of the second intake manifold to regulate flow into the second intake manifold, and the first and second valves are operated by a controller. The controller activates the first valve with variable width pulses having intervals less than an operating inertia of the refrigerant compression circuit.

15 Claims, 2 Drawing Sheets

DEDICATED PULSING VALVE FOR COMPRESSOR CYLINDER

This application is a 371 National Stage Entry of International Application Number PCT/US2009/053417 filed Aug. 11, 2009, and claims priority to U.S. Provisional Application Ser. No. 61/088,139, entitled "Dedication Pulsing Valve For Compressor Cylinder", filed Aug. 12, 2008, under 35 U.S.C. §119(e), both of which are incorporated herein by reference in their entirety.

FIELD OF THE INVENTION

The present invention relates to compressors for use in refrigerant systems such as air conditioning and refrigeration systems. More particularly, the present invention relates to flow control systems for reciprocating piston compressors.

BACKGROUND

Refrigerant systems typically comprise vapor-compression circuits in which a compressor circulates a refrigerant through an evaporator, an expansion device and a condenser. Typically, in a cooling system an evaporator heat exchanger is positioned within a cooled space and a condenser heat exchanger is positioned outside the space. The evaporator absorbs heat from the space whereby the refrigerant carries the heat to the condenser for discharge to the surroundings. In some systems it is desirable for the temperature within the space to be maintained within a narrow temperature band. For example, it is desirable to maintain temperatures nearly constant in refrigeration units where food products are stored.

Operation of the refrigerant system and the compressor is typically monitored by a controller, which reacts to a temperature sensed within the cooled space. Generally, the temperature within the space is regulated by controlling the flow rate of refrigerant through the vapor-compression circuit, typically by controlling operation of the compressor. Varying the refrigerant flow rate, however, changes the capacity of the vapor-compression circuit, which inhibits precise control of the temperature. For example, if the controller senses that the space is at the proper temperature, the controller can discontinue operation of the compressor. Once the temperature within the space rises above a set temperature limit, the compressor must again be activated. Such an interruption in the refrigerant system produces not only a lag in the ability of the compressor to respond the cooling demands in the space, but an undesirable interruption of the heat exchange capabilities of the condenser and evaporator in the vapor-compression circuit.

Flow of refrigerant through the vapor-compression circuit can also be controlled by placing an actively controlled valve in the vapor-compression circuit between the compressor and the evaporator. The controller issues pulsed control signals to the valve to permit intermittent bursts of refrigerant into the compressor to vary the capacity of the compressor. Thus, the compressor is not required to power down and time lags and inefficiencies in the vapor-compression circuit can be avoided. One such pulse width modulation system is described with respect to a reciprocating piston compressor in U.S. Pat. No. 6,047,556 to Lifson, which is assigned to Carrier Corporation, Syracuse, N.Y. Such a valve is, however, positioned before an intake manifold such that the capacity of the entire compressor is regulated by the valve. One other system integrates a pulse width modulation valve directly into a cylinder head of the compressor, as is described in U.S. Patent Application 2006/0218959 to Sandkoetter, which is assigned to Bitzer Kuehlmaschinenbau, Sindelfingen, Germany. Such a compressor, however, requires customized components and adds undesirable complexity to the compressor.

SUMMARY

Exemplary embodiments of the invention include a reciprocating piston compressor for use in a vapor-compression circuit. In one embodiment, the compressor comprises first and second intake manifolds, first and second reciprocating piston compression units, an outlet manifold and a first pulsing valve. The first and second intake manifolds are configured to segregate inlet flow into the compressor. The first and second reciprocating piston compression units are configured to receive flow from the first and second intake manifolds, respectively. The outlet manifold is configured to collect and distribute compressed refrigerant from the first and second compression units. The first pulsing valve is mounted externally of the first intake manifold and is configured to regulate refrigerant flow into the first intake manifold.

DETAILED DESCRIPTION

Figure 1:
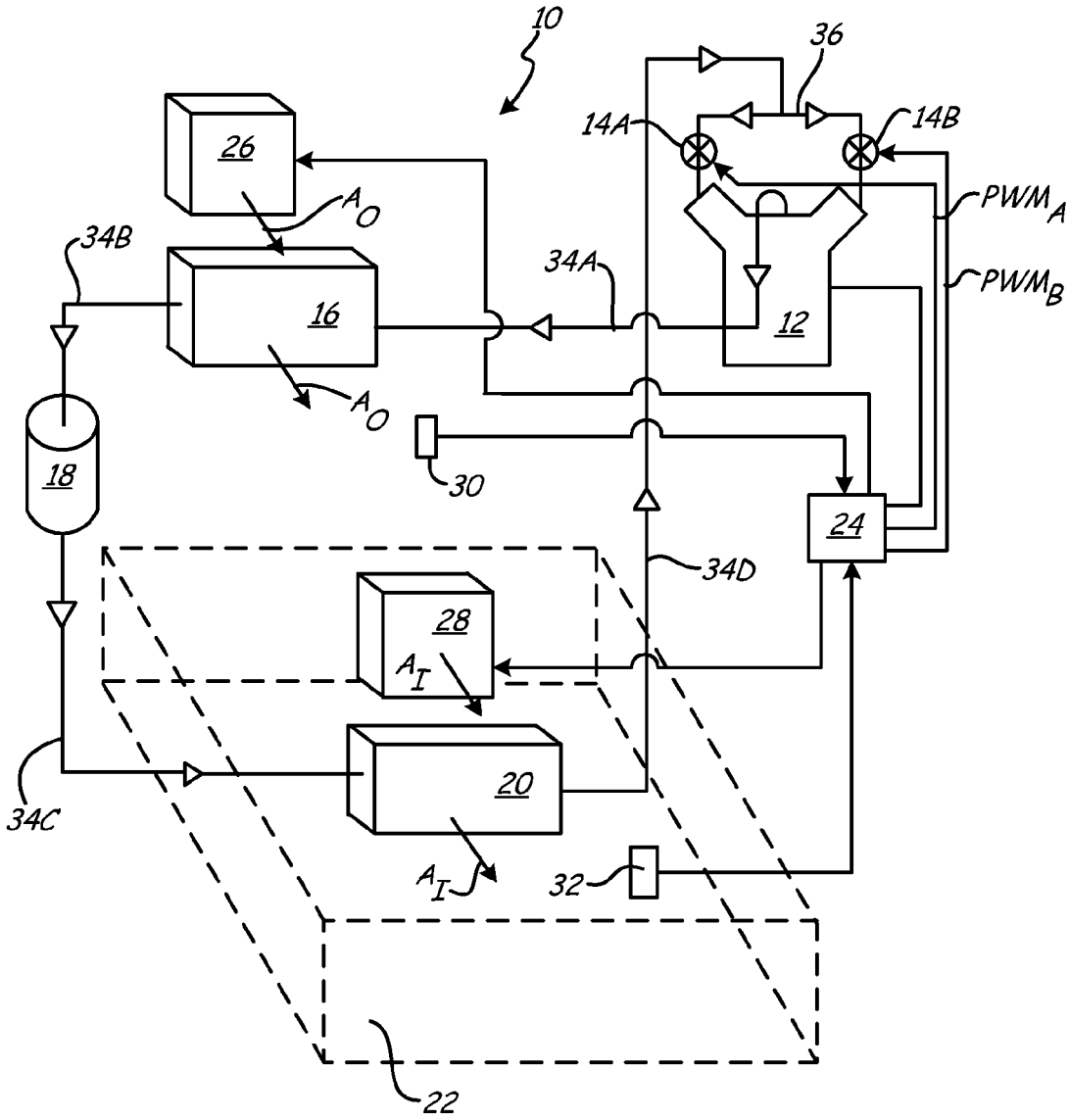
FIG. 1 shows a schematic of a vapor-compression circuit having a compressor including a split intake line with actively controlled valves of the present invention.

FIG. 1 shows a schematic view of refrigerant system 10 incorporating compressor 12 and inlet valves 14A and 14B of the present invention. Refrigerant system 10 also includes condenser heat exchanger 16, expansion device 18 and evaporator heat exchanger 20, which are connected in series to form a vapor-compression circuit that provides cooled air to space 22. Refrigerant system 10 is configured as a split system in which evaporator 20 is positioned inside of space 22, and compressor 12, condenser 16 and expansion device 18 are positioned outside of space 22. Refrigerant system 10 is connected to a control system, which includes controller 24, exterior fan 26, interior fan 28, exterior sensor 30 and interior sensor 32. Based upon factors such as temperature and humidity sensed by sensors 30 and 32, controller 24 operates fans 26 and 28, compressor 12 and valves 14A and 14B to provide cooled and conditioned air to space 22. Space 22 comprises a climate controlled space such as within a refrigerator or a shipping container in which the temperature is regulated within a narrow range. Inlet valves 14A and 14B regulate the flow of a refrigerant flowing through the vapor-compression circuit to control the amount of cooling that takes place within space 22. Specifically, valves 14A and 14B limit the amount of refrigerant that enters compressor 12 to reduce the flow of refrigerant to condenser 16.

In the embodiment shown, compressor 12 is used in conjunction with a vapor-compression circuit to compress a refrigerant. Any suitable refrigerant as is known in the industry may be used such as R-22, R404a, R-134a or $CO_2$ refrigerants. Compressor 12 may also be used in other applications to compress other fluid or matter. While providing cooled air to space 22, compressor 12 compresses a refrigerant to a high temperature and a high pressure such that the refrigerant is comprised substantially of superheated vapor. The refrigerant is discharged from compressor 12 at discharge line 34A to condenser 16 outside of space 22, while controller 24 activates fan 26 to deliver relatively cooler outdoor air $A_O$ across condenser 16. Condenser 16 provides the surface area of the refrigerant within a plurality of interior flow circuits such that outdoor air $A_O$ and the refrigerant are better able to exchange heat. The refrigerant cools and condenses to a saturated liquid at a high pressure, rejecting heat to the exterior of space 22. Outdoor air $A_O$ absorbs heat from the refrigerant within condenser 16 as outdoor air $A_O$ is passed through condenser 16 by fan 26. Next, the refrigerant travels from condenser 16 through line 34B and is passed through expansion device 18, which lowers the pressure and temperature of the refrigerant such that the refrigerant converts to a two-phase state of liquid and vapor in an expansion process. The cold refrigerant continues to flow into evaporator 20 through line 34C, where controller 24 activates fan 28 to deliver relatively warmer indoor air $A_I$ across evaporator 20. Indoor air $A_I$ dumps heat to the refrigerant within evaporator 20 as indoor air $A_I$ passes over heat exchange circuits of evaporator 20. The refrigerant evaporates and absorbs heat from the relatively warmer indoor air $A_I$ such that the refrigerant is vaporized. The hot vapor is then drawn into compressor 12 through intake line 34D and split line 36 where it is compressed and heated into a high temperature, high pressure vapor such that the cycle can be repeated.

Refrigerant system 10 utilizes the pressure differentials produced by compressor 12 and expansion device 18, and the heat transfer capabilities of condenser 16 and evaporator 20 to remove heat from space 22. Thus, the capacity of system 10 to remove heat from space 22 depends on the mass flow rate of refrigerant cycled through lines 34A-34D. The present invention utilizes valves 14A and 14B to control the flow rate of refrigerant through compressor 12. Specifically, valves 14A and 14B, which are provided outside of compressor 12 for easy access, regulate the capacity of individual compression cylinders within compressor 12. In various embodiments of the invention, valves 14A and 14B comprise pulsing valves that are actuated by controller 24 on time scales less than the thermal inertia of the vapor-compression circuit of system 10.

The thermal inertia of system 10 is correlated to the change in temperature of the refrigerant within evaporator 20 after circulation of refrigerant through system 10 is stopped. In a conventional compressor-driven refrigerant system after a conditioned spaced is sufficiently cooled, compressor valves are closed to cease flow through the evaporator for a period of time that typically results in thermal inertia of the system degrading system performance upon resumption of refrigerant flow. In the present invention, valves 14A and 14B are operated by controller 24 to avoid thermal inertia from affecting the performance of system 10. Specifically, controller 24 typically closes at least one of inlet valves 14A and 14B in short pulses that are less than the thermal inertial of the system such that the temperature in the conditioned environment is not significantly affected. In one embodiment, one of valves 14A and 14B is held closed while the other is pulsed such that the capacity of compressor 12 is reduced and flow of refrigerant is only momentarily stopped in an interval that does not affect system performance. In another embodiment, one of valves 14A and 14B is pulsed while the other remains open to reduce the capacity of compressor 12.

Figure 2:
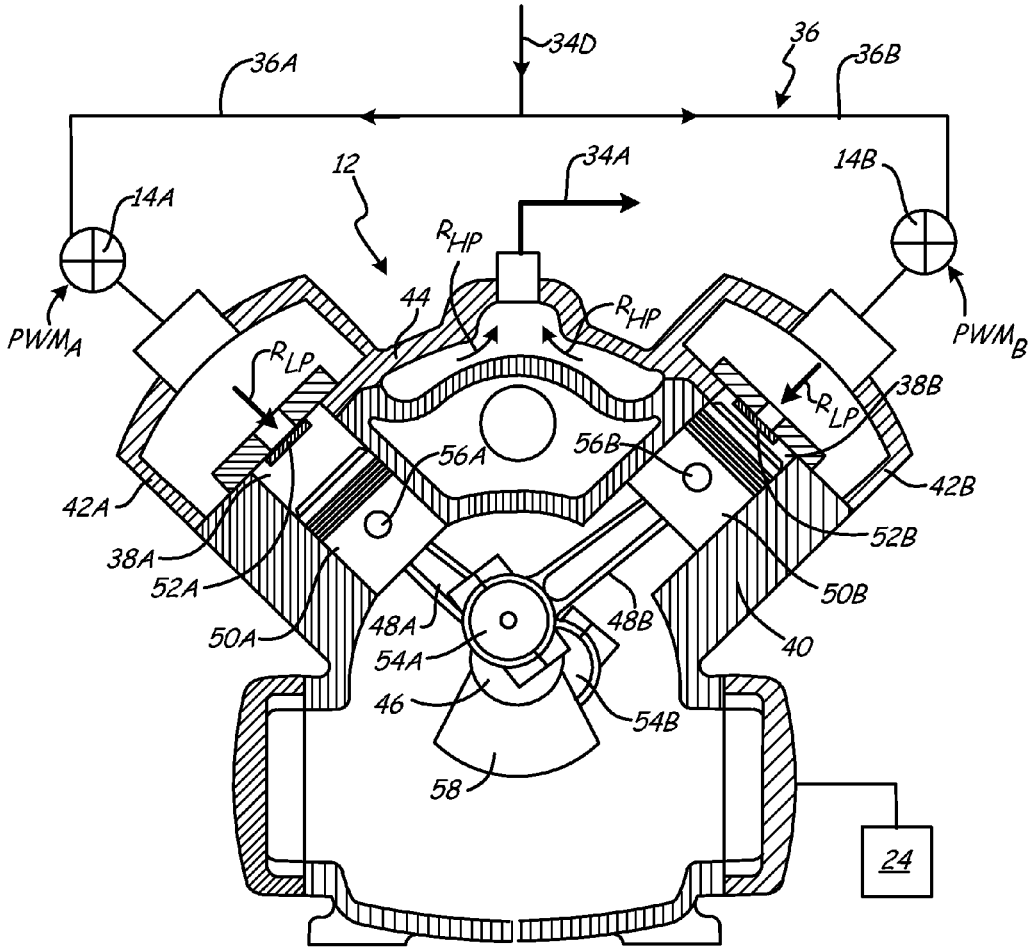
FIG. 2 shows a diagrammatic cross section of the reciprocating piston compressor of FIG. 1 having compression cylinders with dedicated inlet valves.

FIG. 2 shows a diagrammatic cross section of reciprocating piston compressor 12 of FIG. 1 having compression cylinders 38A and 38B with dedicated inlet valves 14A and 14B, respectively. Compressor 12 also includes housing 40, first intake manifold 42A, second intake manifold 42B, discharge manifold 44, crankshaft 46, first connecting rod 48A, second connecting rod 48B, first piston head 50A and second piston head 50B. Reciprocating piston compressors, which provide high compression ratios, are particularly suitable for refrigerant systems operating with $CO_2$ refrigerant that typically operate at pressures that are approximately five times as high as other refrigerants such as R134A or R22.

FIG. 2 shows compressor 12 configured as a V-block type compressor having two reciprocating piston compression units each fed by one of split intake lines 36A and 36B. In other embodiments, compressor 12 may have additional reciprocating piston compression units similar to those shown in FIG. 2, each having an individual split line extending from intake line 34D. For example, compressor 12 may have three compression cylinders, each having an intake manifold, a split intake line and a dedicated inlet valve. In another embodiment, a third compression cylinder is fed by an intake line split from intake line 36A or 36B. In any embodiment, compressor 12 is provided with at least one pulse width modulation valve that permits regulation of one compression cylinder from full to zero capacity. The other compression cylinders may be controlled by, for example, on/off valves or pulse width modulation valves, or may be left without a valve. The inlet valves are operated in concert to control the capacity of compressor 12 from approximately zero to one-hundred percent. FIG. 2 is described with respect to both valves 14A and 14B comprising pulse width modulation valves, one of which may be substituted with an on/off valve in other embodiments.

Within compressor 12, piston heads 50A and 50B are disposed within piston cylinders 38A and 38B, respectively. Piston heads 50A and 50B are connected to crankshaft 46 through connecting rods 48A and 48B, respectively. Connecting rods 48A and 48B are connected to crankshaft 46 with clamped connections at crankpins 54A and 54B, respectively, which have centers that are offset from the center of crankshaft 46. Connecting rods 48A and 48B are connected to piston heads 50A and 50B at pinned connections 56A and 56B, respectively. Crankshaft 46 is connected to a prime mover, such as an electric motor or an engine, to rotate crankshaft 46 about its central axis. Crankpins 54A and 54B are offset such that rotation of crankshaft 46 produces a circular orbiting motion of crankpins 54A and 54B about the central axis of crankshaft 46. Connecting rods 48A and 48B are rotatably connected to crankpins 54A and 54B and pivotably connected to piston heads 50A and 50B such that the orbiting motion of crankpins 54A and 54B produces a reciprocating motion of heads 50A and 50B within piston cylinders 38A and 38B. Counterbalance 58 offsets the weight of unbalanced components attached to crankshaft 46, such as rods 48A and 48B. Thus, heads 50A and 50B provide compression of the refrigerant of the vapor-compression circuit of refrigerant system 10 within cylinders 38A and 38B.

Compressor 12 produces a pressure differential between intake line 34D and discharge line 34A such that heated vapor refrigerant from evaporator 20 (FIG. 1) is pulled toward intake manifolds 42A and 42B through split line 36. Refrigerant flowing from intake line 34D is split into two streams at its juncture with split line 36. A first stream of refrigerant is directed to first split line 36A whereby it flows through first intake valve 14A and into first intake manifold 42A. A second stream of refrigerant is directed to second split line 36B whereby it flows through second intake valve 14B and into second intake manifold 42B. First intake manifold 42A and second intake manifold 42B are segregated from each other such that once the first and second streams of refrigerant are separated at split line 36, they are not rejoined until the compression process in cylinders 38A and 38B is completed. Controller 24 provides pulse width modulation valve control signals $PWM_A$ and $PWM_B$ to regulate the position of inlet valves 14A and 14B, respectively. The flow of refrigerant through split lines 36A and 36B is controlled by inlet valves based upon the pulse widths of the $PWM_A$ and $PWM_B$ signals.

Low pressure refrigerant $R_{LP}$ passes from split lines 36A and 36B through valves 14A and 14B into intake manifolds 42A and 42B. From within first and second intake manifolds 42A and 42B, low pressure refrigerant $R_{LP}$ is pulled into cylinders 38A and 38B through the action of compressor 12. Cylinders 38A and 38B include suction valves 52A and 52B, respectively, and discharge valves (not shown) which regulate flow through compressor 12. The discharge valves are positioned in a discharge manifold in a cross section not shown in FIG. 2, as is known in the art. Suction valves 52A and 52B and the discharge valves comprise any valves as is known in the art suitable for use in a reciprocating piston compressor, such as solenoid valves. During a suction stroke, rod 48A pulls piston head 56A away from intake manifold 42A as crankpin 54A rotates away from cylinder 38A. Cylinder 38A is sealed such that a lower pressure is produced within cylinder 38A that causes suction valve 52A to open and a discharge valve within cylinder 38A to close. Thus, low pressure refrigerant $R_{LP}$ flows from intake manifold 42A to compression cylinder 38A. During a compression stroke, rod 48A pushes piston head 56A toward intake manifold 42A as crankpin 54A rotates toward cylinder 38A. Cylinder 38A is sealed such that pressure builds within cylinder 38A that causes suction valve 52A to close and a discharge valve within cylinder 38A to open at a threshold pressure. Thus, high pressure refrigerant $R_{HP}$ is pushed into discharge manifold 44 from cylinder 38A. Simultaneously while piston head 50A is undergoing alternating suction and compression strokes, piston head 50B is undergoing alternating compression and suction strokes. Thus, low pressure refrigerant $R_{LP}$ also flows from intake manifold 42B into cylinder 38B whereby it is compressed and discharged as high pressure refrigerant $R_{HP}$ into discharge manifold 44. High pressure refrigerant $R_{HP}$ from discharge manifold 44 continues into discharge line 34A whereby it is returned to the vapor-compression circuit and condenser 16 (FIG. 1).

Flow of low pressure refrigerant $R_{LP}$ from split line 36 into intake manifolds 42A and 42B is regulated by valves 14A and 14B, which are controlled by controller 24. Controller 24 includes a microprocessor that coordinates operation of valves 14A and 14B based upon data sensed from refrigerant system 10, such as the temperature of space 22, to vary the capacity of compressor 12 depending on cooling needs. In one embodiment of the invention, first inlet valve 14A and second inlet valve 14B comprise pulse width modulation valves. Any pulse width modulation valve that rapidly responds to an input signal may be used with the present invention, such as a solenoid valve or a directly actuated valve. Controller 24 meters flow of low pressure refrigerant $R_{LP}$ into intake manifolds 42A and 42B by issuing pulsed control signals to valves 14A and 14B to maintain the temperature of space 22 within a narrow band. Controller 24 actively modulates the capacity of first cylinder 38A by controlling the percentage of time that inlet valve 14A is open. Similarly, controller 24 actively modulates the capacity of second cylinder 38B by controlling the percentage of time that inlet valve 14B is open. Specifically, controller 24 operates valves 14A and 14B in intervals smaller than the time it takes for the thermal inertia of evaporator 20 to rise above the temperature at which system performance begins to degrade. For example, in one embodiment, valves 14A and 14B have a duty cycle of about 0.5 wherein valves 14A and 14B are operated in on/off intervals of ten seconds. However, the microprocessor of controller 24 can be programmed to operate valves 14A and 14B in any intervals to avoid thermal inertia issues with evaporator 20.

Controller 24 and valves 14A and 14B permit the capacity of individual reciprocating piston compression cylinders 38A and 38B to be independently regulated such that the overall operating capacity of compressor 12 can be regulated between zero and one-hundred percent. For example, individual pulse width modulation of valves 14A and 14B allows each of cylinders 38A and 38B to be operated anywhere between zero and full capacity, each representing fifty percent of the capacity of compressor 12. Thus, the capacity of compressor 12 can be precisely controlled from anywhere between zero to one-hundred percent.

In other embodiments of the invention, one of valves 14A and 14B can comprise a conventional on/off valve, which can be actively or manually operated, and the other can comprise a pulse width modulation valve. As such, the capacity of compressor 12 can be coarsely controlled with the on/off valve, and finely adjusted with the pulse width modulation valve. For example, with the on/off valve on, one cylinder provides compressor 12 with fifty percent capacity, while the pulse width modulation valve is modulated to regulate the capacity of the other fifty percent. Similarly, one cylinder can be left open, or not provided with a valve, such that the cylinder is continuously providing fifty percent capacity to compressor 12. As such, the capacity of compressor 12 can be set anywhere between fifty percent and one hundred percent. With the on/off valve off, one cylinder prevents compressor 12 from receiving fifty percent capacity, while the pulse width modulation valve is modulated to regulate the capacity of the other fifty percent. As such, the capacity of compressor 12 can be set anywhere between zero percent and fifty percent.

Regulation of capacity from zero to one-hundred percent with a single pulse width modulation valve can be extended to compressors having any number of compression cylinders. One cylinder receives the pulse width modulation valve, while the remaining cylinders are either not provided with a valve or are provided with a non-modulated valve. For example, a three cylinder compressor can be provided with one pulse width modulation valve and one of: 1) two on/off valves, 2) two open cylinders or 3) one on/off valve and one un-valved or open cylinder. Thus, the present invention permits rapid, small-scale adjustment of the capacity of a compressor by providing a pulse width modulation valve on a compression unit to enable precise climate control of temperature sensitive spaces such as refrigerators.

Pulse width modulation of valves 14A and 14B also permits compressor 12 to operate without interruption during operation of refrigerant system 10. Compressor 12 continuously operates to circulate refrigerant through system 10 while valves 14A and 14B continuously operate to regulate the capacity of compressor 12 and the amount of refrigerant circulated through system 10. Thus, it is unnecessary to power down operation of compressor 12 to adjust the capacity of compressor 12. Continuous operation of compressor 12 allows for tight temperature control within the conditioned space. Continuous operation of compressor 12 also eliminates delays in circulating refrigerant through system 10 by eliminating the time required for compressor 12 to begin to compress the refrigerant upon activation.

Compressor 12 and valves 14A and 14B also provide refrigerant system 10 with a low cost, easily fabricated and repaired, capacity-regulated compressor system. For example, valves 14A and 14B are connected to the exterior of compressor 12, rather than being integrated into a complex and elaborate header system. As such, valves 14A and 14B are cost effective because "off the shelf" or conventional valves can be used. Such valves are known to have life cycles therein in excess of several million cycles, which results in infrequent replacement. In the event of replacement or repair, valves 14A and 14B are accessible without the need for removing intake manifolds 42A or 42B from housing 40 or otherwise disassembling compressor 12. Furthermore, split lines 36A and 36B are produced from standard piping or conduit such as is used for lines 34A-34D, further reducing fabrication time and expense to build and repair refrigerant system 10. Thus, the need for customized valves, headers and piping is eliminated with the present invention.

Although the present invention has been described with reference to preferred embodiments, workers skilled in the art will recognize that changes may be made in form and detail without departing from the spirit and scope of the invention.

The invention claimed is:

1. A reciprocating piston compressor comprising:

a housing a first intake manifold and a second intake manifold disposed at the housing for segregating inlet flow into the compressor;

a first reciprocating piston compression unit and a second reciprocating piston compression unit both disposed at the housing to receive flow from the first intake manifold and second intake manifold, respectively;

an outlet manifold for collecting and distributing compressed refrigerant from the first reciprocating compression unit and the second reciprocating compression unit;

a common feed line extending from a discharge of a heat exchanger and including a first split section extending into the first intake manifold and a second split section extending into the second intake manifold;

a first pulsing valve disposed at the first split section; and a second pulsing valve disposed at the second split section.

2. The reciprocating piston compressor of claim 1 wherein the second pulsing valve comprises an on-off valve configured to stop or start refrigerant flow into the second intake manifold.

3. The reciprocating piston compressor of claim 1 and further comprising a controller to actuate the first pulsing valve and the second pulsing valve, wherein the controller actuates the first pulsing valve and the second pulsing valve to regulate capacity of the compressor from zero to one-hundred percent without affecting operation of the first reciprocating piston compression unit and the second reciprocating piston compression units.

4. The reciprocating piston compressor of claim 3 wherein the controller regulates capacity of the first and second reciprocating piston compression units individually.

5. The reciprocating piston compressor of claim 3 wherein the controller operates the first pulsing valve in time intervals less than approximately ten seconds in an on/off duty cycle of approximately 0.5.

6. The reciprocating piston compressor of claim 1 wherein the first pulsing valve and the second pulsing valve are removable from the intake line without removal of the first and second intake manifolds of the compressor.

7. The reciprocating piston compressor of claim 1, wherein the first pulsing valve is held closed while the second pulsing valve is pulsed to reduce a capacity of the compressor.

8. The reciprocating piston compressor of claim 1, wherein the first pulsing valve is held open while the second pulsing valve is pulsed to reduce a capacity of the compressor.

9. A vapor-compression circuit for a refrigerant, the circuit comprising:

a condenser;

an expansion device configured to receive refrigerant from the condenser;

an evaporator configured to receive refrigerant from the expansion device;

a split intake line configured for receiving refrigerant from the evaporator, the split intake line having a first discharge branch and a second discharge branch; and a compressor comprising:

a housing a first reciprocating piston compression chamber disposed at the housing and connected to the first branch;

a second reciprocating piston compression chamber disposed at the housing and connected to the second branch;

a first pulsing valve disposed in the first branch to regulate refrigerant flow into the first compression chamber;

a second pulsing valve disposed in the second branch to regulate refrigerant flow into the second compression chamber; and a joint discharge line configured to receive refrigerant from the first and second compression chambers and for directing refrigerant to the condenser.

10. The vapor-compression circuit of claim 9 and further comprising a controller for operating the first pulsing valve and the second pulsing valve such that output of the compressor can be regulated from zero to full capacity without a reduction in operating speed of the reciprocating piston compression chambers.

11. The vapor-compression circuit of claim 9 wherein the refrigerant comprises a carbon dioxide refrigerant.

12. The vapor-compression circuit of claim 9 wherein the compressor further comprises first and second intake manifolds for separately directing refrigerant from the first and second branches to the first and second reciprocating piston compression chambers.

13. The vapor-compression circuit of claim 9 and further comprising a third reciprocating-piston compression chamber connected to the first branch, and a fourth reciprocating-piston compression chamber connected to the second branch, wherein the first pulsing valve regulates flow into the first and third compression chambers.

14. The vapor-compression circuit of claim 9, wherein the first pulsing valve is held closed while the second pulsing valve is pulsed to reduce a capacity of the compressor.

15. The vapor-compression circuit of claim 9, wherein the first pulsing valve is held open while the second pulsing valve is pulsed to reduce a capacity of the compressor.

* * * * *